US010426994B1

(12) United States Patent
Campanaro et al.

(10) Patent No.: US 10,426,994 B1
(45) Date of Patent: Oct. 1, 2019

(54) EXERCISE DEVICE HANDLE AND METHOD OF USING SAME

(71) Applicant: Total Gym Global Corp., Carlsbad, CA (US)

(72) Inventors: Thomas J. Campanaro, Rancho Santa Fe, CA (US); Jesse T. Campanaro, San Diego, CA (US)

(73) Assignee: TOTAL GYM GLOBAL CORP., Carlsbad, CA (US)

( * ) Notice: Subject to any disclaimer, the term of this patent is extended or adjusted under 35 U.S.C. 154(b) by 0 days.

(21) Appl. No.: 16/121,895

(22) Filed: Sep. 5, 2018

(51) Int. Cl.
*A63B 21/00* (2006.01)
*A63B 22/00* (2006.01)
*A63B 17/04* (2006.01)

(52) U.S. Cl.
CPC ..... *A63B 21/4035* (2015.10); *A63B 17/04* (2013.01); *A63B 22/0076* (2013.01); *A63B 2208/0204* (2013.01)

(58) Field of Classification Search
CPC ..... A63B 21/4035; A63B 2022/0076; A63B 2022/0079; A63B 2022/0082; A63B 21/15–156; A63B 49/08; A63C 11/22
See application file for complete search history.

(56) References Cited

U.S. PATENT DOCUMENTS 1,975,021 A * 9/1934 Schmidt ..... A63B 21/012 482/114
3,601,395 A * 8/1971 Morgan ..... A63B 22/0002 482/62
D226,151 S 1/1973 Pawsat
3,837,642 A 9/1974 Martin
D262,730 S 1/1982 Lambert et al.
4,911,438 A * 3/1990 Van Straaten ..... A63B 21/068 482/130
4,973,043 A * 11/1990 Nolan ..... A63B 21/154 482/106
D324,894 S 3/1992 Porcello
5,312,314 A 5/1994 Stephan et al.
D394,482 S 5/1998 Colonello
D396,510 S 7/1998 Marney
5,938,571 A * 8/1999 Stevens ..... A63B 21/068 482/135
7,093,698 B1 8/2006 Chen
D565,133 S 3/2008 Mollet
7,350,437 B2 4/2008 Mangano et al.
8,147,391 B1 * 4/2012 Hill ..... A63B 21/4035 482/132
D662,161 S 6/2012 Miller
D725,455 S 3/2015 Carlini
9,147,391 B2 9/2015 Bieler
9,254,410 B1 2/2016 Mirza
D777,625 S 1/2017 Chang
9,724,593 B2 * 8/2017 Sandusky ..... A63C 17/0013
9,770,622 B2 * 9/2017 Campanaro ..... A63B 22/0087
D812,158 S 3/2018 Campanaro et al.
D812,159 S 3/2018 Campanaro et al.
(Continued)

*Primary Examiner* — Nyca T Nguyen
(74) *Attorney, Agent, or Firm* — Procopio Cory Hargreaves and Savitch LLP

(57) ABSTRACT

An exercise device handle for an exercise device comprises a handle tube including at least one straight portion, at least one bent portion, and opposite ends; and a stand-up paddle boarding (SUP) grip at one or both of the opposite ends of the handle tube.

17 Claims, 3 Drawing Sheets

(56) References Cited

U.S. PATENT DOCUMENTS

| | | | | |
|---|---|---|---|---|
| D815,575 | S | 4/2018 | Temmerman | |
| 2001/0052213 | A1* | 12/2001 | Panatta | A63B 22/02 52/508 |
| 2005/0143230 | A1 | 6/2005 | Dalebout et al. | |
| 2007/0184950 | A1* | 8/2007 | Bradley | A63B 23/12 482/141 |
| 2010/0018341 | A1 | 1/2010 | Greppi | |
| 2010/0186543 | A1 | 7/2010 | Menghini | |
| 2012/0100965 | A1* | 4/2012 | Dreissigacker | A63B 21/0088 482/72 |
| 2013/0340661 | A1* | 12/2013 | Siverts | B63B 35/7959 114/39.12 |
| 2015/0119212 | A1* | 4/2015 | Rodriguez | A63B 21/4035 482/139 |
| 2015/0174445 | A1* | 6/2015 | Robertson, Jr. | A63B 23/0405 482/93 |
| 2015/0291268 | A1* | 10/2015 | Shoemaker | B63H 16/04 440/101 |
| 2017/0216653 | A1* | 8/2017 | Parr | A63B 21/0722 |
| 2018/0001127 | A1 | 1/2018 | Caouette | |

* cited by examiner

EXERCISE DEVICE HANDLE AND METHOD OF USING SAME

FIELD OF THE INVENTION

The present invention relates to a handles used with exercise devices.

SUMMARY OF THE INVENTION

An aspect of the invention involves an exercise device handle for an exercise device comprising a handle tube including at least one straight portion, at least one bent portion, and opposite ends; and a stand-up paddle boarding (SUP) grip at one or both of the opposite ends of the handle tube.

One or more implementations of the aspect of the invention described immediately above include one more of the following: the SUP grip is at least twice as wide as the at least one straight portion; the SUP grip includes a central portion that is bowed outward; a sleeve that the central straight base portion of the handle tube rotates within; ring members disposed along and rotating relative to the sleeve, the central straight base portion fixed to and within the ring members so that the central straight base portion and the ring members rotate relative to the sleeve; the at least one straight portion and at least one bent portion includes a central straight base portion, straight handle tube portions, and angled tube portions; the handle tube includes at the opposite ends a straight portion that extends in the same direction as the straight handle tube portions, an incurved portion that is concave up towards the central straight base portion, an increased width portion that increases gradually in width, and the SUP grip; the central straight base portion, the straight portion, and the straight handle tube portions extend primarily in an X direction; the angled tube portions, the incurved portion, and the increased width portion extend primarily in X and Y directions; and/or the SUP grip extends primarily in the Z direction.

Another aspect of the invention involves an exercise device comprising: a support structure; a movable user support movably associated with the support structure for movement relative to the support structure; a movable foot support movably associated with the support structure for movement relative to the support structure; the exercise device handle of the aspect of the invention described immediately above; and a rowing assembly operatively associated with the exercise device handle and at least the movable foot support to cause at least the movable foot support to move relative to the support structure with movement of the exercise device handle so that both a user's body and feet move relative to the support structure with movement of the exercise device handle.

One or more implementations of the aspect of the invention described immediately above include one more of the following: grabbing the exercise device handle at the SUP grip and at the at least one straight portion; and performing stand-up paddle boarding (SUP) style paddling on the exercise device; performing stand-up paddle boarding (SUP) style paddling on the exercise device causes the rowing assembly to cause at least the movable foot support to move relative to the support structure with rowing movement of the exercise device handle so that both a user's body and feet move relative to the support structure with movement of the exercise device handle; and/or the support structure includes an adjustable inclination, and the method of using the exercise device further including adjusting the inclination of the support structure to adjust rowing resistance.

A further aspect of the invention involves an exercise device comprising a tower; a support structure inclinable at different angles relative to the tower; a movable user support platform movably associated with the support structure for movement relative to the support structure; a pulley system associated with the exercise device; a cable extending through the pulley system and including opposite ends; the exercise device handle of the aspect of the invention described further above; coupled to the ends of the pulley system, whereby movement of the exercise device handle causes movement of the movable user support platform relative to the support structure.

One or more implementations of the aspect of the invention described immediately above include one more of the following: grabbing the exercise device handle at the SUP grip and at the at least one straight portion; and performing stand-up paddle boarding (SUP) style paddling on the exercise device; performing stand-up paddle boarding (SUP) style paddling on the exercise device causes the cable to impart movement of the movable user support platform relative to the support structure; and/or adjusting the angle of support structure relative to the tower to adjust rowing resistance.

BRIEF DESCRIPTION OF THE DRAWINGS

FIG. 1 is a front perspective view of an embodiment of an inclinable exercise device with an embodiment of an exercise device handle shown there with;

FIG. 2 is a front perspective view of another embodiment of an inclinable exercise device with an embodiment of an exercise device handle shown there with;

DETAILED DESCRIPTION OF PREFERRED EMBODIMENTS

With reference initially to FIGS. 1-5, an embodiment of an exercise device handle 10 will be described. Two exemplary inclinable exercise devices 20, 30 that the exercise device handle 10 may be used with will first be described.

Figure 1:
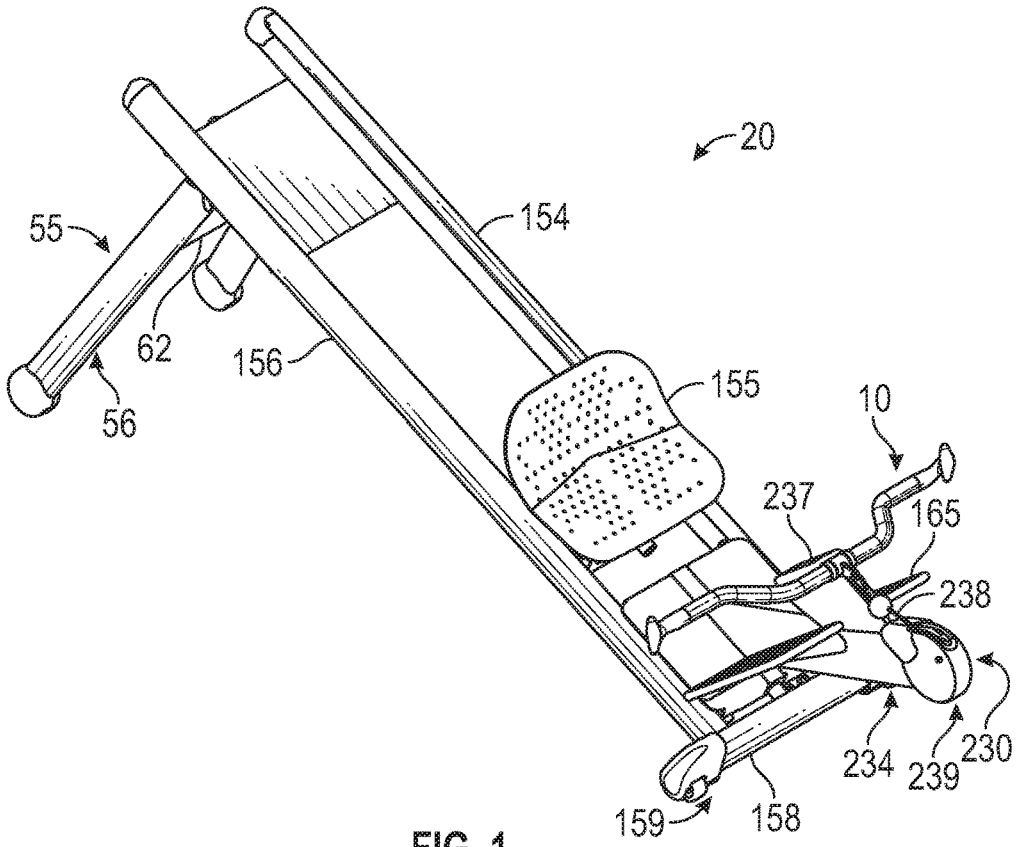

With reference to FIG. 1, the inclinable exercise devices 20 is a rowing exercise device having a movable user support (e.g., seat) 155 rollably mounted via rollers (not shown) on a support structure 154. The support structure 154 shown includes a pair of inclined rails 156 secured to a cross bar 158 at their lower ends and supported in an inclined orientation at a selected inclination angle by an adjustable support assembly 55.

The adjustable support assembly 55 supports the rails 156 and is adjustable so that the rails 156 extend at a desired inclination angle to provide a desired resistance. Adjustable support assembly 55 comprises legs 56 and a cross bar 62 extending between the legs 56. At its upper end, adjustable support assembly 55 is pivotally connected to the rails 156 at pivot (not shown).

At an opposite end of the exercise device 20 is a cross bar 158 coupled to the lower ends of the rails 156. The cross bar 158 includes wheels 159 to allow the user to roll the exercise device 20 around the room.

A rowing assembly 220 of the exercise device 20 will be described. The rowing assembly 220 includes a series of pulleys (not shown) that cable 238 is operatively associated with. A movable foot support (e.g., foot carriage) 230 moves along the rails 156 via the rollers. The movable foot support 230 includes an angled support tower/mast 234. The angled support tower 234 houses a lower pulley (not shown) and an upper/top pulley 239, supports a pair of fixed external foot plates/pedals 165 on opposite sides of the tower 234, and carries a computer display assembly 237. The exercise device handle 10 is attached at one end of the cable 238, which runs through the pulleys and is connected to the movable foot support 230 at an opposite end of the cable 238 from where the exercise device handle 10 is attached.

In use, a user gets on the rowing exercise device 20 to start a rowing workout session and gets off the exercise device 20 after a rowing session is completed in the mount/dismount position shown in FIG. 1. In this position, the user is in a crouched position with legs/knees substantially bent, arms substantially straight with hands holding onto the rowing exercise device 20, and torso substantially perpendicular relative to the rails 156. To row, the user leans rearward, pulls the exercise device handle 10 (and cable 238) towards the torso, and pushes against the foot plates 165 with the feet, straightening the legs. As the user pulls the exercise device handle 10, the movable foot support 230 moves up the inclined rails 156 at a rate proportionate to the rate that the user pulls on the exercise device handle 10/cable 238. The angle of the rails 156, which may be adjusted, determines the amount of resistance (percentage of user's body weight) the user 242 must overcome to pull the movable foot support 230, user, and movable user support 155 up the inclined rails 156 to a finish position up on the rails 156. To return to the mount/dismount position, the user simultaneously straightens the arms, bends the torso forward, and bends the legs. This causes the movable foot support 230 to move down the inclined rails 156 to the position shown in FIG. 1. As the user rows, going up and down the inclined rails 156, the user experiences substantially the same amount of resistance both when pulling (going up the rails 156) and returning (going down the rails 156), unlike a traditional level/horizontal rowing machine where substantial resistance only occurs on pulling. Thus, the rowing exercise device 20 is unique in that it is the only entirely bodyweight resistance rowing machine with both eccentric and concentric resistance. While rowing, the user's feet are moving because the foot plates 165 are moving up and down the rails 156. The user's movement up and down the rails 156 gives the user a unique "riding" experience.

Figure 2:
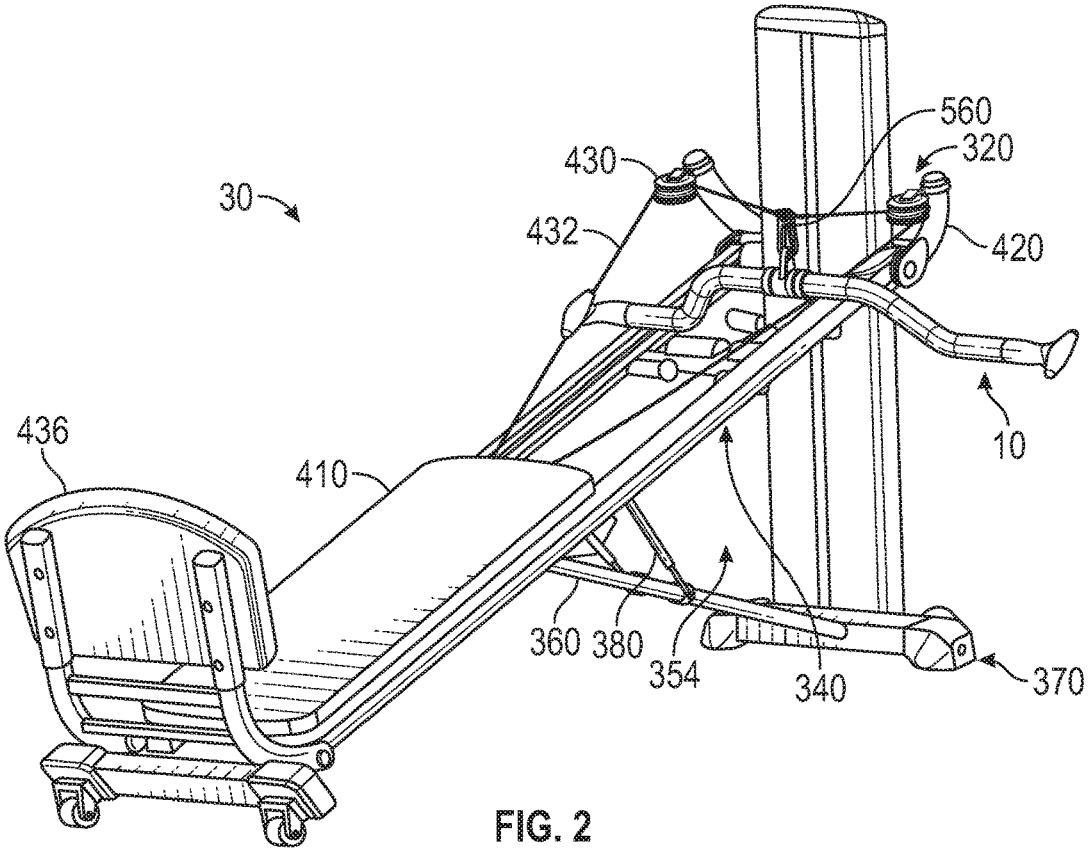

With reference to FIG. 2, the inclinable exercise device 30 includes a tower 320 with a carriage (not shown) vertically slidable along the tower 320. A support structure 354 includes rails 340. A strut 360 is pivotally connected at one end to a base 370 and pivotally coupled to rails 340. A lift-assist mechanism 380 is pivotally connected at one end to the strut 360 and is pivotally connected at an opposite end to the rails 340. A user support platform or glideboard 410 with rollers (not shown) rolls along the rails 340. The carriage is coupled to pulley arms 420. Attached to the pulley arms 420 are pulleys 430. A cable 432 extends through the pulleys 430 and connects to the user support platform 410 and couples to the exercise device handle 10 at opposite ends. The cable extends through the pulleys 430 positioned on the pulley arms 420 and loops through a third pulley (not shown) attached to the user support platform 410. A foot platform 436 is coupled to a lower part of rails 340.

In use, a user adjusts the height of the carriage within the tower 320 so that the rails 340 are at a desired angle. The user gets on the exercise device 30 by sitting on or lying on the user support platform 410. The user pulls (or otherwise moves) the exercise device handle 10 (and cable 432), causing the user support platform 410 to move up the inclined rails 340 at a rate proportionate to the rate that the user pulls on the exercise device handle 10/cable 432. The angle of the rails 340, which may be adjusted by adjusting the height of the carriage within the tower 320 as described above, determines the amount of resistance (percentage of user's body weight) the user must overcome to pull the user support platform 410 and user up the inclined rails 340. As the user pulls (or otherwise moves) the exercise device handle 10 (and cable 432) toward and away from the bottom of the rails 340, the user moves up and down the inclined rails 340 on the user support platform 410.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Figure 3:
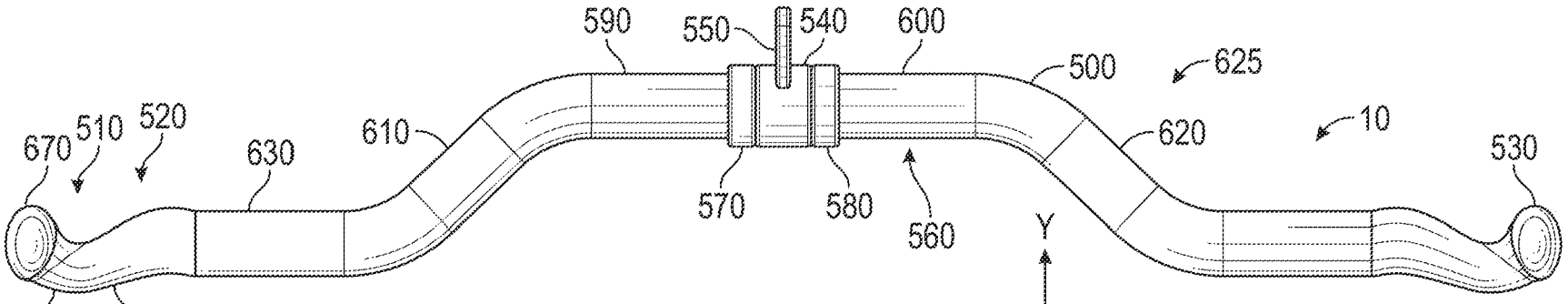
FIG. 3 is a front elevational view of the exercise device handle shown in FIGS. 1 and 2.
Figure 4:
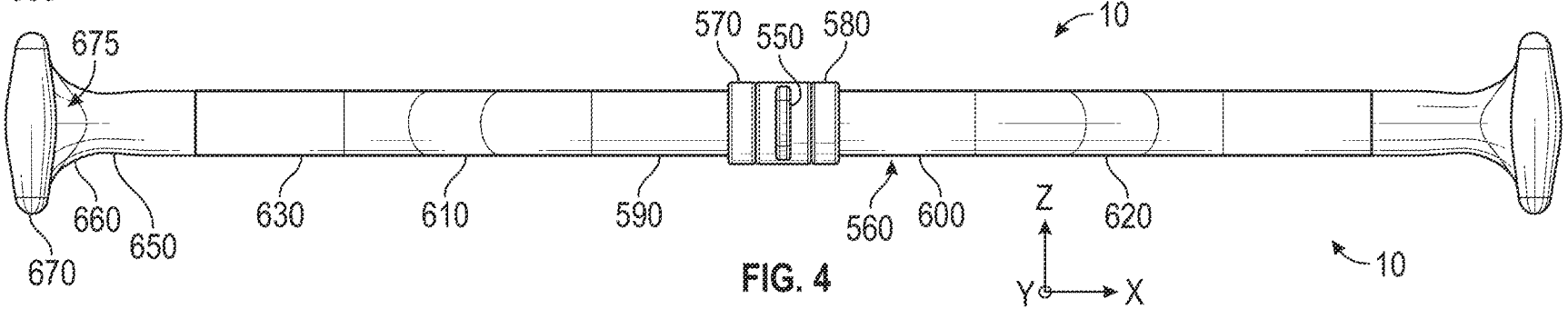
FIG. 4 is a top plan view of the exercise device handle shown in FIGS. 1 and 2.
Figure 5:
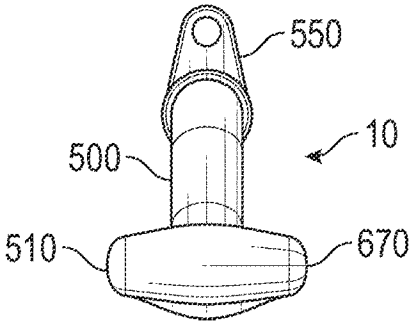
FIG. 5 is a left side elevational view of the exercise device handle shown in FIGS. 1 and 2.

With reference to FIGS. 3-5, the exercise device handle 10 will now be described in more detail. The exercise device handle 10 includes a handle tube 500 having handle members 510 at opposite ends 520, 530, and is rotatable within a sleeve 540, which is coupled to the aforementioned cables 238, 432 via a hook 550 and a carabiner-type clip 560. The handle tube 500 includes a central straight base portion 560 that is disposed within the sleeve 540 and ring members 570, 580. The ring members 570, 580 are disposed along and rotate relative to opposite ends of the sleeve 540. The central straight base portion 560 is fixed to and within the ring members 570, 580 so that the central straight base portion 560 and the ring members 570, 580 rotate relative to the sleeve 540. Straight handle tube portions 590, 600 of the central straight base portion 560 are connected to straight portion 630 via angled tube portions or easy curl grips 610, 620, which form at least one bent portion 625 of the exercise device handle 10. The straight portions 630 terminate in the handle members 510 at opposite ends 530. The straight portion 630 extends in the same direction as the straight handle tube portions 590, 600. Each handle member 510 includes an incurved portion 650 that is concave up towards the central straight base portion 560, and an increased width portion 660 that increases gradually in width, progressing from the incurved portion 650 to ergonomic stand-up paddle boarding (SUP) grip member 670. The grip member 670 is at least twice as wide as the straight portion of the handle members 510, is bowed outward in a central portion 675 and is configured to be gripped by the hands of the user in the same manner as gripping a grip on the end of a SUP paddle or a grip on the end of a canoe paddle. The central straight base portion 560, the straight portion 630, and the straight handle tube portions 590, 600 extend primarily in the X direction. The angled tube portions 610, 620, the incurved portion 650, and the increased width portion 660 extend primarily in the X and Y directions. The grip member 670 extends primarily in the Z direction.

Figure 6:
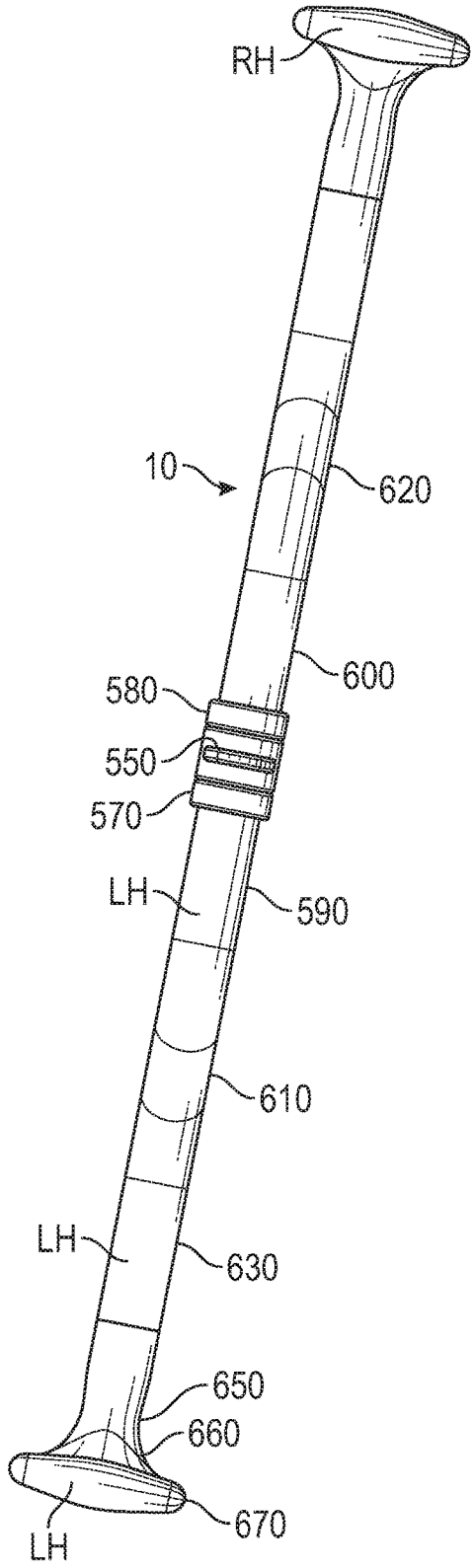
FIGS. 6 and 7 are additional front elevational views of the exercise device handle shown in FIGS. 1-5, and show exemplary hand locations on the exercise device handle during stand-up paddle boarding (SUP) style paddling/rowing.
Figure 7:
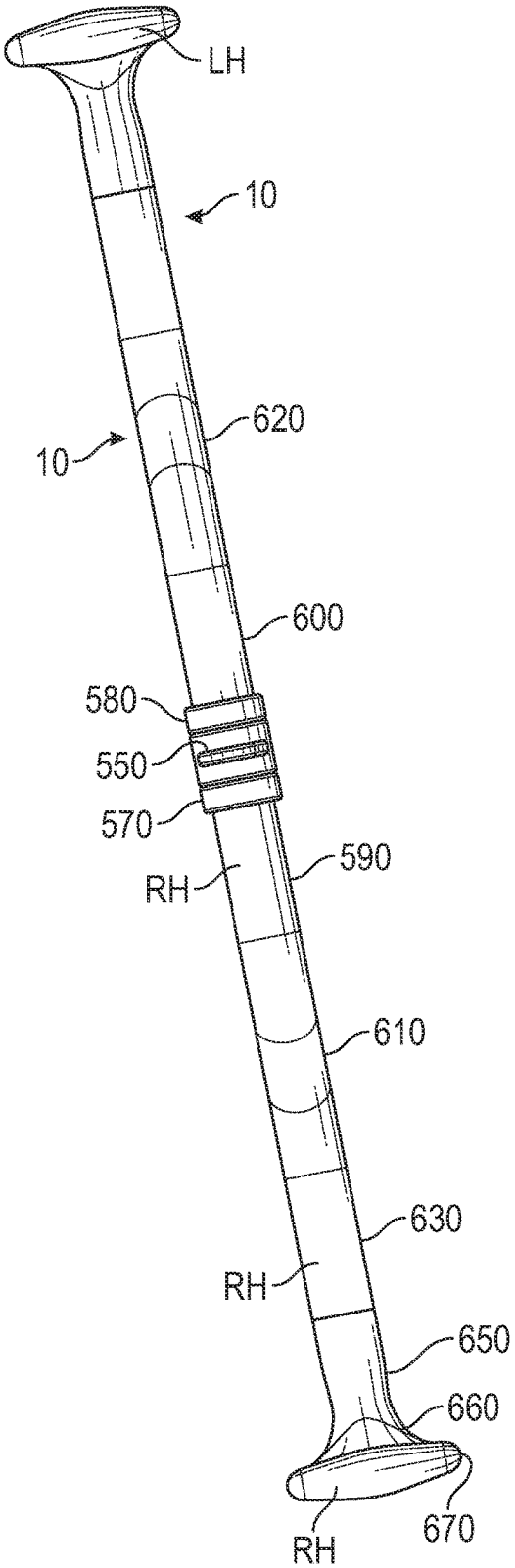

In use, the user may grab the exercise device handle 10 with one's hands at the central straight base portion 560, the angled tube portions 610, 620, the straight handle tube portions 590, 600, and/or at the SUP grip members 670 of the handle members 510. The user may grip the exercise device handle 10 at one or more of these locations to perform one or more of the following exercises on the inclinable exercise device(s) 20, 30 (and/or other exercise machines): a full range of motion row exercise, biceps curls with multiple grip locations including at easy curl grips 610, 620, stand-up paddle boarding (SUP) style paddling motion, canoe rowing, torso rotation, overhead toss, and/or or other exercises. With reference to FIGS. 6 and 7, for example, a method of using the inclinable exercise device(s) 20, 30 (and/or other exercise machines) comprises grabbing one of the SUP grip members 670 of the exercise device handle 10 with one's right hand RH (FIG. 6) or one's left hand LH (FIG. 7) and grabbing the exercise device handle 10 with one's opposite hand LH (FIG. 6), RH (FIG. 7) at straight portion 590, 600, 630 (or opposite SUP grip member 670 at an opposite end of the exercise device handle 10); and performing stand-up paddle boarding (SUP) style paddling/rowing on the exercise device 20, 30 (and/or other exercise machines). With each paddling/rowing movement of the exercise device handle 10, the cable 238, 432 imparts motion to the movable user support 155, 410 with the user thereon with the angle of incline of the adjustable incline support structure 134, 354 determining the amount of rowing resistance.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. An exercise device handle for an exercise device, comprising:

a handle tube including at least one straight portion, at least one bent portion, and opposite ends;

a stand-up paddle boarding (SUP) grip at both of the opposite ends of the handle tube, the SUP grip is at least twice as wide as the at least one straight portion, is bowed outward in a central portion, and is configured to be gripped by hands of a user in the same manner as gripping a grip on the end of a SUP paddle or a grip on the end of a canoe paddle, the SUP grip extending primarily in a Z direction, the at least one straight portion extending primarily in an X direction, and the at least one bent portion extending primarily in the X and Y directions, the at least one straight portion and at least one bent portion includes a central straight base portion;

an incurved portion that is concave up in a Y direction and transitions into an increased width portion that increases gradually in width in a Z direction, progressing from the incurved portion to the SUP grip.

2. The exercise device handle of claim 1, wherein the exercise device handle further including a sleeve that the central straight base portion of the handle tube rotates within.

3. An exercise device, comprising:

a support structure;

a movable user support movably associated with the support structure for movement relative to the support structure;

a movable foot support movably associated with the support structure for movement relative to the support structure;

the exercise device handle of claim 1;

a rowing assembly including a cable and one or more pulleys operatively associated with the exercise device handle and at least the movable foot support to cause at least the movable foot support to move relative to the support structure with movement of the exercise device handle so that both a user's body and feet move relative to the support structure with movement of the exercise device handle.

4. An exercise device, comprising:

a tower;

a support structure inclinable at different angles relative to the tower;

a movable user support platform movably associated with the support structure for movement relative to the support structure;

a pulley system associated with the exercise device;

a cable extending through the pulley system;

the exercise device handle of claim 1 coupled to the cable, whereby movement of the exercise device handle causes movement of the movable user support platform relative to the support structure.

5. A method of using the exercise device of claim 4, comprising:

grabbing the exercise device handle at the SUP grip with one hand and grabbing another location of the exercise device handle with another hand;

performing stand-up paddle boarding (SUP) paddling or rowing with the exercise device handle with one hand grabbing the SUP grip and another hand grabbing the exercise device at another location whereby each paddling or rowing movement of the exercise device handle, imparts motion to the movable user support on the exercise device.

6. The method of claim 5, wherein performing stand-up paddle boarding (SUP) paddling or rowing on the exercise device causes the cable to impart movement of the movable user support platform relative to the support structure.

7. The method of claim 6, further including adjusting the angle of support structure relative to the tower to adjust rowing resistance.

8. An exercise device handle for an exercise device, comprising:

a handle tube including at least one straight portion, at least one bent portion, and opposite ends;

a stand-up paddle boarding (SUP) grip at both of the opposite ends of the handle tube, wherein the SUP grip is at least twice as wide as the at least one straight portion, is bowed outward in a central portion, and is configured to be gripped by hands of a user in the same manner as gripping a grip on the end of a SUP paddle or a grip on the end of a canoe paddle, the SUP grip extending primarily in a Z direction, the at least one straight portion extending primarily in an X direction, and the at least one bent portion extending primarily in the X and Y directions, the at least one straight portion and at least one bent portion includes a central straight base portion and the exercise device handle further including a sleeve that the central straight base portion of the handle tube rotates within, the at least one straight portion and at least one bent portion includes a central straight base portion, straight handle tube portions, and angled tube portions.

9. The exercise device handle of claim 8, wherein the handle tube includes at the opposite ends a straight portion that extends in the same direction as the straight handle tube portions, an incurved portion that is concave up towards the central straight base portion, an increased width portion that increases gradually in width, and the SUP grip.

10. The exercise device handle of claim 8, wherein the central straight base portion of the at least one straight portion, and the straight handle tube portions extend primarily in an X direction.

11. The exercise device handle of claim 9, wherein the angled tube portions, the incurved portion, and the increased width portion extend primarily in X and Y directions.

12. A method of using an exercise device, comprising:

providing the exercise device comprising a support structure; a movable user support movably associated with the support structure for movement relative to the support structure; a movable foot support movably associated with the support structure for movement relative to the support structure; an exercise device handle for the exercise device comprising a handle tube including at least one straight portion, at least one bent portion, and opposite ends; a stand-up paddle boarding (SUP) grip at both of the opposite ends of the handle tube, wherein the SUP grip is at least twice as wide as the at least one straight portion, is bowed outward in a central portion, and is configured to be gripped by hands of a user in the same manner as gripping a grip on the end of a SUP paddle or a grip on the end of a canoe paddle, the SUP grip extending primarily in a Z direction, the at least one straight portion extending primarily in an X direction, and the at least one bent portion extending primarily in X and Y directions; a rowing assembly including a cable and one or more pulleys operatively associated with the exercise device handle and the movable foot support to cause at least the movable foot support to move relative to the support structure with movement of the exercise device handle so that both the user's body and feet move relative to the support structure with movement of the exercise device handle;

grabbing the exercise device handle at the SUP grip with one hand and grabbing another location of the exercise device handle with another hand;

performing stand-up paddle boarding (SUP) paddling or rowing with the exercise device handle with one hand grabbing the SUP grip and another hand grabbing the exercise device at another location whereby each paddling or rowing movement of the exercise device handle, imparts motion to the movable user support via the cable and one of more pulleys on the exercise device.

13. The method of claim 12, wherein performing stand-up paddle boarding (SUP) paddling or rowing on the exercise device causes the rowing assembly to cause at least the movable foot support to move relative to the support structure with rowing movement of the exercise device handle so that both the user's body and feet move relative to the support structure with movement of the exercise device handle.

14. The method of claim 13, wherein the support structure includes an adjustable inclination, and the method of using the exercise device further including adjusting the inclination of the support structure to adjust paddling or rowing resistance.

15. The method of claim 12, wherein grabbing the exercise device handle at the SUP grip with one hand and grabbing another location of the exercise device handle with another hand includes grabbing the exercise device handle at the SUP grips at both of the opposite ends of the handle tube.

16. The method of claim 12, wherein the exercise device handle includes an incurved portion that is concave up in the Y direction and transitions into an increased width portion that increases gradually in width in the Z direction, progressing from the incurved portion to the SUP grip, and grabbing the exercise device handle at the SUP grip with one hand includes grabbing the exercise device handle at the SUP grip adjacent to the increased width portion.

17. An exercise device handle for an exercise device, comprising:

a handle tube including at least one straight portion, at least one bent portion, and opposite ends;

a stand-up paddle boarding (SUP) grip at both of the opposite ends of the handle tube, wherein the SUP grip is at least twice as wide as the at least one straight portion, is bowed outward in a central portion, and is configured to be gripped by hands of a user in the same manner as gripping a grip on the end of a SUP paddle or a grip on the end of a canoe paddle, the SUP grip extending primarily in a Z direction, the at least one straight portion extending primarily in an X direction, and the at least one bent portion extending primarily in the X and Y directions, the at least one straight portion and at least one bent portion includes a central straight base portion and the exercise device handle further including a sleeve that the central straight base portion of the handle tube rotates within, ring members disposed along and rotating relative to the sleeve, the central straight base portion of the at least one straight portion fixed to and within the ring members so that the central straight base portion of the at least one straight portion and the ring members rotate relative to the sleeve.

* * * * *